US010389015B1

(12) United States Patent
Judd

(10) Patent No.: US 10,389,015 B1
(45) Date of Patent: Aug. 20, 2019

(54) DUAL POLARIZATION ANTENNA

(71) Applicant: Judd Strategic Technologies, LLC, Rockwall, TX (US)

(72) Inventor: Mano D. Judd, Heath, TX (US)

(73) Assignee: Mano D. Judd, Heath, TX (US)

( * ) Notice: Subject to any disclaimer, the term of this patent is extended or adjusted under 35 U.S.C. 154(b) by 81 days.

(21) Appl. No.: 15/210,583

(22) Filed: Jul. 14, 2016

(51) Int. Cl.
*H01Q 1/28* (2006.01)
*H01Q 25/00* (2006.01)
*H01Q 5/392* (2015.01)

(52) U.S. Cl.
CPC ..... *H01Q 1/28* (2013.01); *H01Q 5/392* (2015.01); *H01Q 25/001* (2013.01)

(58) Field of Classification Search
CPC ..... H01Q 1/28; H01Q 5/392; H01Q 25/001
USPC ..... 343/705
See application file for complete search history.

(56) References Cited

U.S. PATENT DOCUMENTS 2,374,271 A * 4/1945 Brown ..... H01Q 21/245 343/798
2,480,153 A * 8/1949 Masters ..... H01Q 9/285 343/795
2,486,872 A * 11/1949 Parker ..... H01Q 21/26 343/797
3,509,575 A * 4/1970 Kawamoto ..... H01Q 21/29 343/795
3,541,559 A * 11/1970 Evans ..... H01Q 21/24 343/756
4,198,641 A * 4/1980 Gibson ..... H01Q 21/24 342/361
4,290,071 A * 9/1981 Fenwick ..... H01Q 5/00 343/815
4,710,775 A * 12/1987 Coe ..... H01Q 13/18 343/727
4,812,855 A * 3/1989 Coe ..... H01Q 9/065 343/700 MS
5,280,297 A * 1/1994 Profera, Jr. ..... H01Q 3/46 343/700 MS
5,293,176 A * 3/1994 Elliot ..... H01Q 21/26 343/797
5,784,032 A * 7/1998 Johnston ..... H01Q 1/243 343/702
5,796,372 A * 8/1998 Elliot ..... H01Q 21/26 343/797
5,929,820 A * 7/1999 Caulfield ..... H01Q 3/20 343/761
6,052,098 A 4/2000 Killen et al.
6,057,802 A * 5/2000 Nealy ..... H01Q 9/0407 343/700 MS
6,163,306 A * 12/2000 Nakamura ..... H01Q 1/38 343/700 MS (Continued)

FOREIGN PATENT DOCUMENTS

RU 2359377 C1 * 6/2009 ..... H01Q 21/26

*Primary Examiner* — Daniel Munoz
*Assistant Examiner* — Bamidele A Jegede

(57) ABSTRACT

A dual polarization antenna is described. An antenna under the present disclosure can comprise a plurality of legs, and a plurality of parasitic elements disposed between the legs. Feeds are connected to both the legs and the parasitics. By feeding the parasitics the antenna can be dual polarized, providing greater reception and transmission capabilities, as well as saving space compared to other dual polarized antennas.

6 Claims, 9 Drawing Sheets

(56) References Cited

U.S. PATENT DOCUMENTS 6,366,254 B1 * 4/2002 Sievenpiper ..... H01Q 1/3275 343/770
6,448,937 B1 * 9/2002 Aiken ..... H01Q 21/062 343/817
6,545,647 B1 * 4/2003 Sievenpiper ..... H01Q 21/245 343/756
6,734,829 B1 * 5/2004 Gottl ..... H01Q 1/523 343/797
8,350,773 B1 * 1/2013 Kindt ..... H01Q 13/085 343/767
9,954,280 B1 * 4/2018 Judd ..... H01Q 9/265
2002/0075187 A1 6/2002 McKivergan
2002/0163476 A1 11/2002 Eriksson
2003/0076259 A1 * 4/2003 Zhang ..... H01Q 1/246 343/700 MS
2003/0090430 A1 * 5/2003 Waltho ..... H01Q 1/38 343/795
2005/0116873 A1 6/2005 Castany
2005/0253769 A1 * 11/2005 Timofeev ..... H01Q 1/246 343/797
2006/0097926 A1 * 5/2006 Fujii ..... H01Q 9/0407 343/700 MS
2006/0267200 A1 * 11/2006 Mickle ..... G06K 19/07749 257/754
2007/0290927 A1 * 12/2007 Rowell ..... H01Q 1/241 343/700 MS
2009/0066601 A1 * 3/2009 Eom ..... H01Q 1/2291 343/798
2009/0278746 A1 * 11/2009 Aurinsalo ..... H01Q 9/0435 343/700 MS
2009/0289858 A1 * 11/2009 Olsson ..... H01Q 1/243 343/702
2010/0302118 A1 12/2010 Suleiman et al.
2011/0241972 A1 * 10/2011 Wansch ..... H01Q 1/27 343/893
2012/0146870 A1 * 6/2012 Brown ..... H01Q 19/005 343/795
2012/0293387 A1 11/2012 Ohno
2013/0222199 A1 8/2013 Apostolos
2014/0354510 A1 * 12/2014 Li ..... H01Q 21/062 343/876
2016/0104934 A1 * 4/2016 Jang ..... H01Q 1/38 343/834

* cited by examiner

Equation 1 $Z_{feed} = R + jX$

Equation 2 $R = R_{rad}(L,f) + R_{ohmic}$

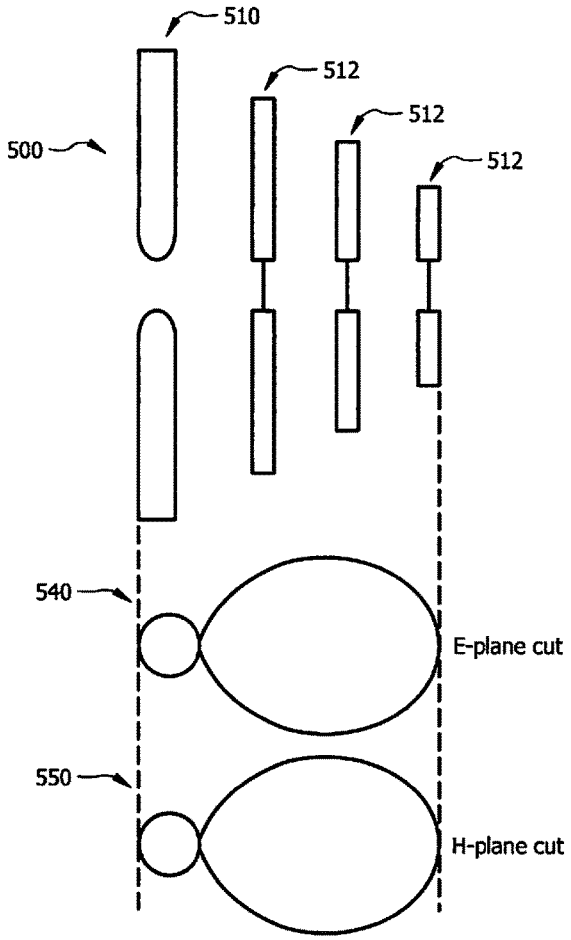
FIG. 5A
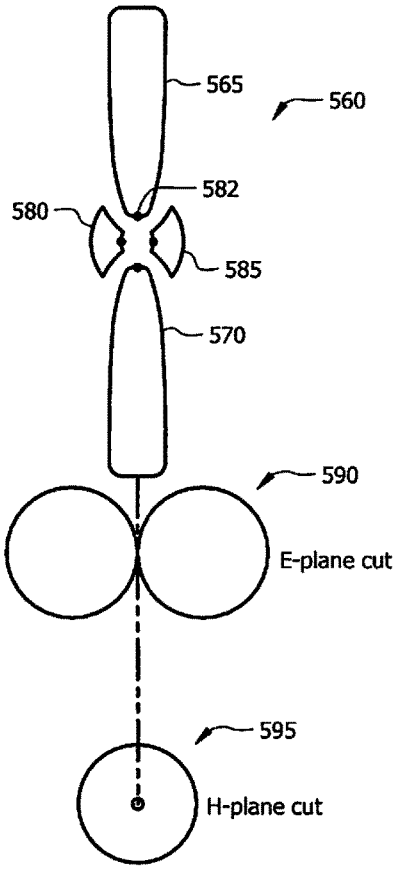
FIG. 5B
Equation 3
$$G(\theta,f) = -(f)\bullet -(f)\bullet \underbrace{D(\theta,f)}_{\text{Directivity}}$$
Gain
M: Matching Efficiency
R: Radiation Efficiency
FIG. 6

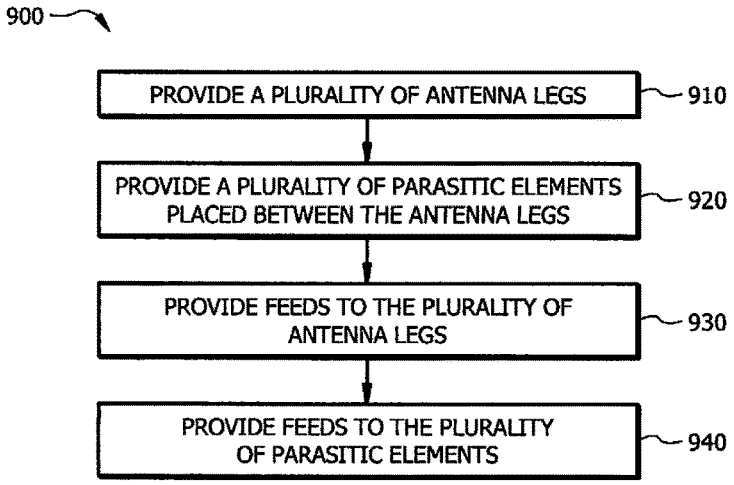
*FIG. 9*
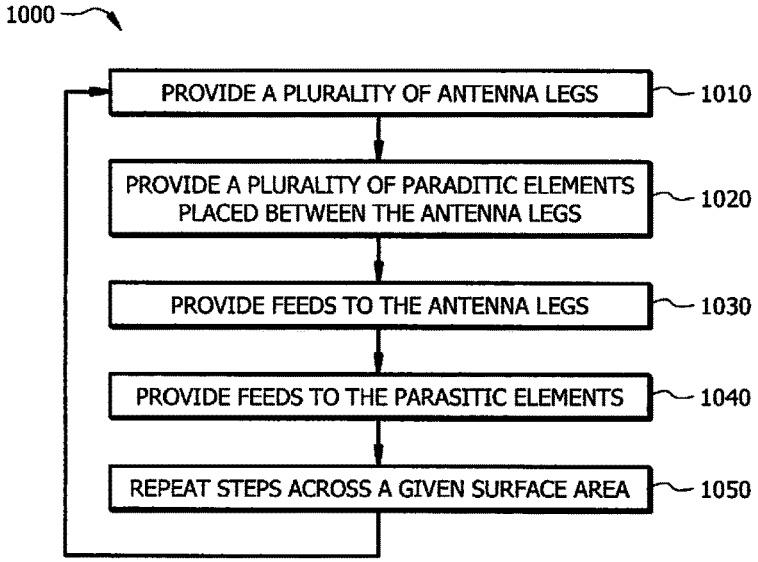
*FIG. 10*
Equation 4
Radar Range Equation
$$R = \sqrt[4]{\frac{P_T\, G_T\, G_R\, \lambda^2\, \sigma\, L_{atmos}}{(4\pi)^3\, P_R\, \text{Duty}}}$$
*FIG. 11*

DUAL POLARIZATION ANTENNA

TECHNICAL FIELD

The present disclosure is directed to antennas and more particularly to an antenna capable of responding to horizontally and vertically polarized radio waves simultaneously.

BACKGROUND OF THE INVENTION

The acceleration and de-acceleration of electrons on a surface, generates electromagnetic radiation. Large groups of electrons comprise currents on the surface of an antenna. That current creates electromagnetic waves that are radiated into space. The direction of the electric field created by that radiation determines the polarization of the antenna. For example, some antennas have a horizontal electric field during use. Other antennas have a vertical electric field. The plane of this electric field, and the direction of propagation, determines the polarization of the antenna. Most antennas only have one polarization. A dual polarization antenna can respond to both horizontal and vertical polarizations at the same time.

BRIEF SUMMARY OF THE INVENTION

One embodiment of the present disclosure comprises an antenna comprising: a plurality of legs comprising connections to a first plurality of antenna feeds; and a plurality of parasitic elements comprising connections to a second plurality of antenna feeds; the plurality of parasitic elements disposed between the plurality of legs; wherein the plurality of legs are configured to be one of vertically or horizontally polarized and the plurality of parasitic elements are configured to be the other of vertically or horizontally polarized.

Another embodiment of the present disclosure comprises an antenna array comprising: a plurality of antennas, wherein each of the plurality of antennas comprises, a plurality of legs comprising connections to a first plurality of antenna feeds; and a plurality of parasitic elements comprising connections to a second plurality of antenna feeds; the plurality of parasitic elements disposed between the plurality of legs; wherein the plurality of legs are configured to be one of vertically or horizontally polarized and the plurality of parasitic elements are configured to be the other of vertically or horizontally polarized.

Another embodiment of the present disclosure comprises a method of constructing a dual polarized antenna comprising: providing a plurality of antenna legs; providing a plurality of parasitic elements placed between the antenna legs; providing a first plurality of feeds to the plurality of antenna legs; and providing a second plurality of feeds to the plurality of parasitic elements.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which:

FIGS. 5A-5B displays embodiments of antennas and antenna behavior under the prior art and under the present teachings;

FIG. 6 shows an equation related to antenna behavior;

FIG. 9 shows a possible method embodiment under the present disclosure;

FIG. 10 shows a possible method embodiment under the present disclosure;

FIG. 11 shows an equation related to antenna behavior; and

DETAILED DESCRIPTION OF THE INVENTION

Figure 1A:
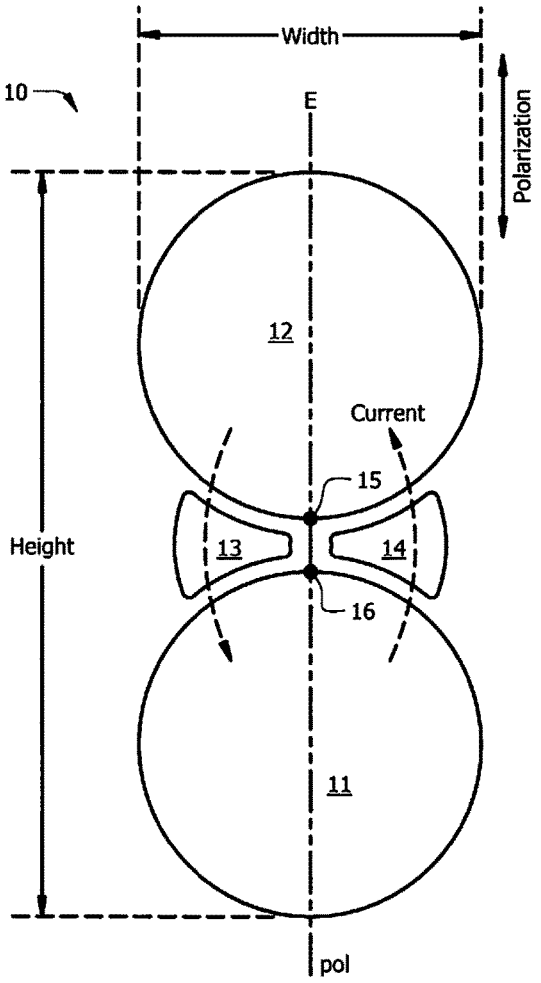
FIGS. 1A-1B show prior art embodiments of single polarization antennas.
Figure 1B:
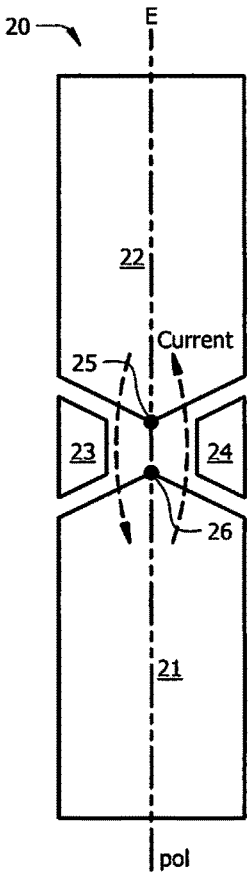

Referring now to FIGS. 1A and 1B, examples of single polarization antennas can be seen. The antenna of FIG. 1A comprises two legs 11, 12, two feeds 15, 16, and two parasitic elements 13, 14. As shown, antenna 10 has a vertical polarization. Current passes from the upper leg to the lower leg and vice versa. Antenna 20 of FIG. 1B shows a similar embodiment: a vertically polarized antenna 20 with feeds 25, 26, and parasitic elements 23, 24. Antenna 20 has a slightly different geometry. For either antenna 10 or 20 to achieve a horizontal polarization the antenna would have to be physically rotated 90 degrees so that it lies in a horizontal position compared to the positions illustrated. The feed impedance of antennas 10, 20 can be governed by the following equation: $Z_{feed} \approx 50\Omega + j$. Antennas 10, 20 are single polarization, single layer, can be made conformal, and are wideband. Generally, 50Ω in the impedance equation comes from the impedance of input cable. As such, perfect matching is close to 50Ω across a variety of antennas/frequencies.

Figure 2:
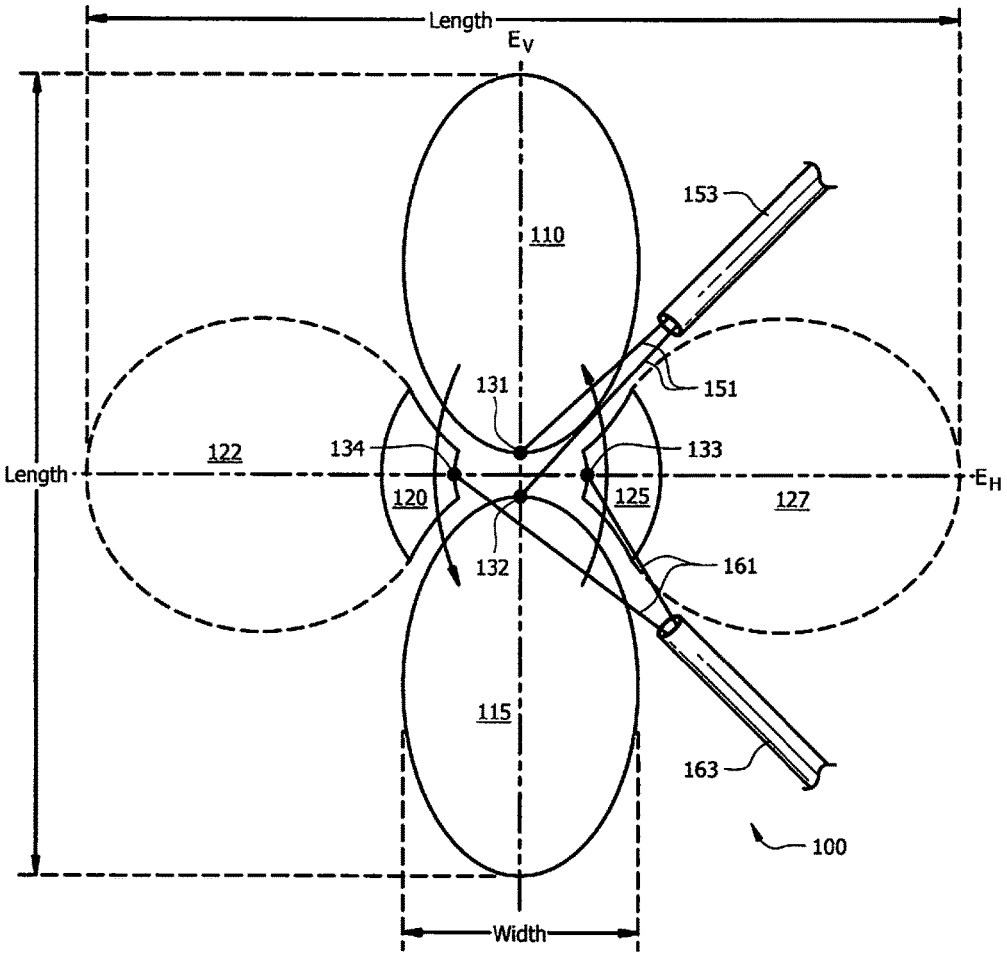
FIG. 2 displays a possible dual polarization antenna embodiment under the present disclosure.

Referring to FIG. 2, one embodiment of a dual polarization antenna 100 under the current disclosure is shown. Antenna 100 comprises legs 110, 115 with feeds 131, 132, and what look like parasitic elements. However, side legs 120, 125, have feeds 133, 134. This allows the antenna to achieve dual polarization. Vertical polarization can be achieved by the current flowing up and down legs 110, 115. The current from side leg 120 to side leg 125 and back, yields a horizontal polarization. Side legs 120, 125 function as both legs and parasitics. Antenna 100 has a variety of advantages. It is single layer and therefore simple to employ, cost effective, and lightweight. The antenna 100 can be conformal to a surface. Antennas under the present disclosure, such as antenna 100, can comprise a single layer of copper, achieving great economic efficiencies. The dual polarization enables resonance at a much lower frequency. The antenna 100 also is very wideband. Feeds 151 (for elements 110, 115, connected to cable 153) and feeds 161 (for elements 120, 125, connected to cable 163) are illustrative of any type of feed or cabling, and merely serve to illustrate one embodiment. Antennas under the present disclosure also provide very low mutual coupling between the legs and parasitics.

Generally, for the ideal antenna, a feed impedance ($Z_{feed}$) is desired of 50 Ohms, with near zero impedance. The value of 50Ω is the typical impedance of cables used to feed an antenna. The equation for feed impedance is $Z_{feed}=R+jX$ (wherein R is total feed resistance, X is reactance, and j is an imaginary impedance operator (j=sqrt(−1))) (see FIG. 3, Equation 1). Combining Equations 1 and 2 yields the equation: $Z_{feed}=R_{rad}+R_{ohmic}+jX$. What is desired is for $R_{ohmic}$ to be approximately 0, and for X(f) to be approximately 0. Thus it is desired that $R_{rad}$ (L,f)=50 Ohms. Under the prior art, with narrow band antennas, as shown in graphs 200, 250 (showing feed resistance and feed reactance of a poor narrowband antenna), $R_{rad}$ goes up with frequency and X oscillates about 0 indefinitely as frequency goes up. This has made it very difficult to achieve 50 at various frequencies for a given antenna.

Figure 4:
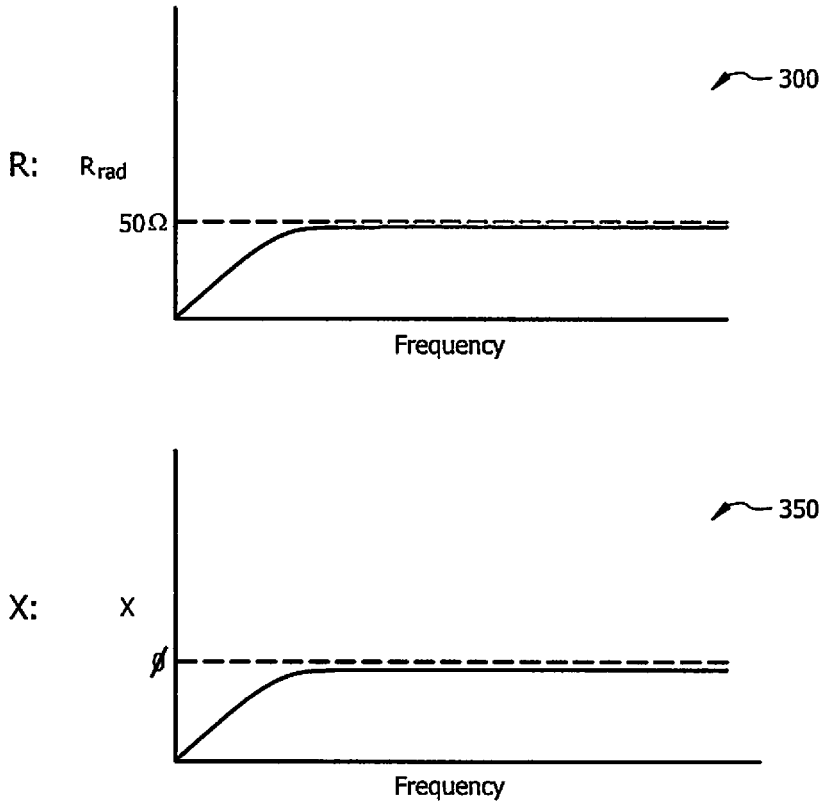
FIG. 4 displays graphs related to antenna behavior under possible embodiments of the present disclosure.

A dual polarization antenna under the present teachings has been able to resolve the problems in the prior art. Referring to FIG. 4, antennas under the present disclosure are capable of 50 Ohm impedance across most frequencies, graph 300 (showing feed resistance of a single pol or dual pol antenna). Furthermore, embodiments under the present teachings achieve a reactance X of approximately 0 across most frequencies, graph 350 (showing feed reactance of a single pol or dual pol antenna). The current antenna does not require a balun. Baluns are used when there is an unbalanced transmission line. Baluns help to balance the line to properly feed a balanced antenna component.

Antennas under the present teachings, such as the embodiment shown in FIG. 2 achieve these goals by using the parasitic structures as impedance matching structures. Further behavior of such an antenna can be seen in FIG. 5B. FIG. 5A shows a prior art antenna 500 with Yagi-Uda parasitic elements 512 called directors. The electric field produced by such an antenna is shown by E-plane cut 540. The H-plane cut is shown by 550. In contrast, E-plane cut 590 and H-plane cut 595 show the E-plane and H-plane cuts of antenna embodiment 560 under the present teachings. Antenna 560 has legs 565, 570 and legs 580, 585 (also called parasitics or impedance matching structures). Each leg has a feed 582. The feed area of antennas under the present disclosure are able to achieve 50Ω to 70Ω impedance. By providing a feed to the legs and the parasitics, the parasitics provide an RF shunt, helping to achieve the proper impedance.

Antennas under the present disclosure have been able to achieve beneficial gain characteristics as well. The gain equation is given in Equation 3 of FIG. 6. Gain is a function of θ (direction) and f (frequency). As seen in Equation 3, gain is a function of matching efficiency ($E_M$), radiation efficiency ($E_R$), and directivity (D). In the prior art, $E_M$ and $E_R$ have always been limited to narrow band. Good directivity has generally been achievable. Using antennas under the present disclosure has allowed wide bandwidths to be achieved, from an operating frequency ratio of 3:1 up to 10:1, and even greater in some circumstances depending on θ. Preferred embodiments have a ratio of 3:1 or 4:1. Stable radiation efficiency is also found. Regarding Equation 1, $Z_{feed}$ is able to be matched to 50Ω from about 0.3λ to nearly infinity. This allows for stable radiation efficiency.

Under the present disclosure $R_{rad}$~50Ω has been achieved for values greater than 0.3*L, and out to at least 13:1. Also for 0.3*L, X(f)~0. Furthermore, $R_{ohmic}$ is minimal due to no lumped element losses. $R_{ohmic}$ becomes bounded by loss tangent and conductor losses.

Figure 3:
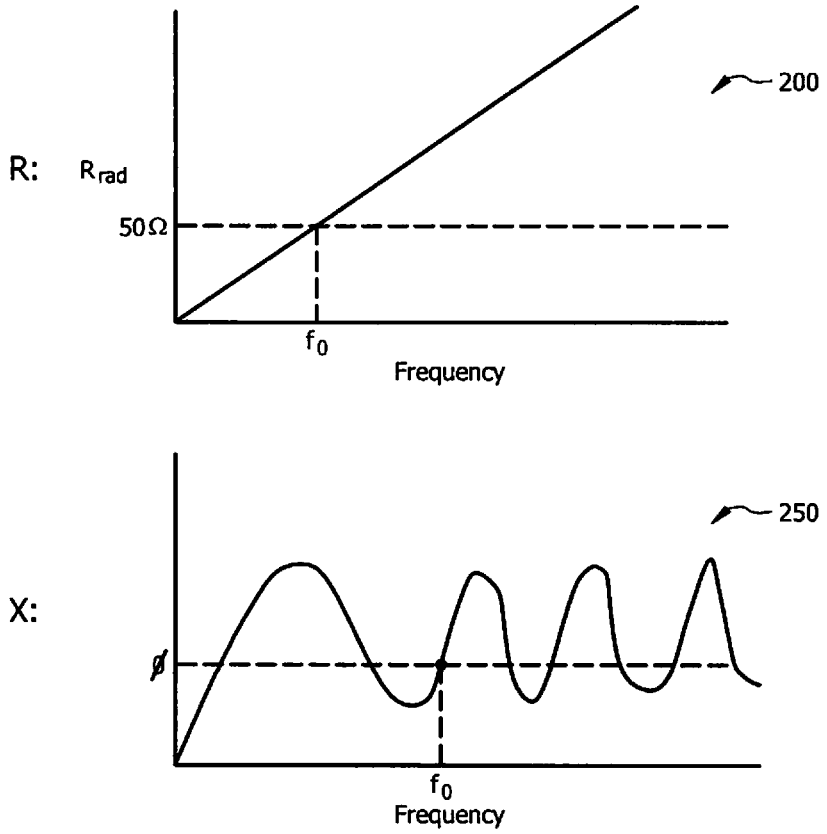
FIG. 3 displays graphs and equations related to prior art antenna behavior.

In the prior art, antennas have been governed by the equation: $G(\theta,f)=E_M(f)*E_R(f)*D(\theta,f)$. $E_M(f)$ has always been narrow band. $E_R(f)$ has been good, but always narrow band. D(θ,f) has allowed for a variety of choices. FIG. 3 shows a comparison of how the prior art antennas have behaved, and also antennas under the present disclosure. As seen, prior art antennas have been difficult to tune and match, as total resistance and impedance goes up with frequency. However, under the present disclosure, total resistance and impedance is able to be maintained at 50Ω regardless of the frequency.

Sample prior art antennas that have attempted to achieve similar results include the Vivaldi antenna (notch antenna) which had good feed impedance over frequency and a wide bandwidth. However the Vivaldi requires two copper layers and a relatively high internal volume. It would therefore be difficult to build into aircraft. Spiral antennas also achieve some good results, such as wideband performance. However spirals cannot achieve linear dual polarization (vertical and horizontal). Some of the advantages of the present disclosure include great feed impedance over frequency, linear dual polarization, single layer fabrication (such as by copper), and therefore easier construction when applied to aircraft.

Figure 7A:
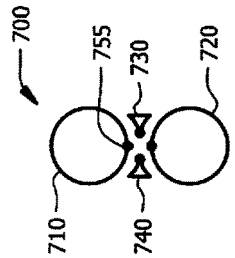
FIGS. 7A-7L show possible antenna embodiments under the present disclosure.
Figure 7B:
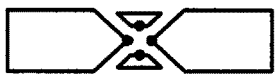
Figure 7C:
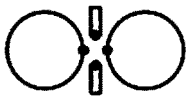
Figure 7D:
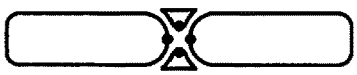
Figure 7E:
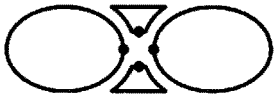
Figure 7F:
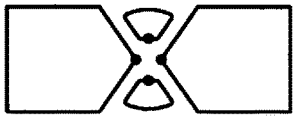
Figure 7G:
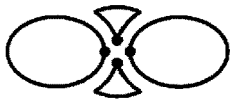
Figure 7H:
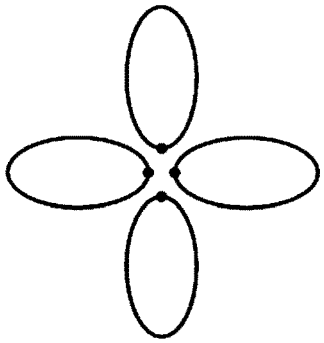
Figure 7I:
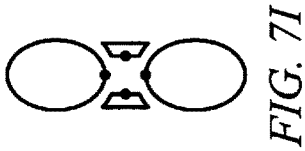
Figure 7J:
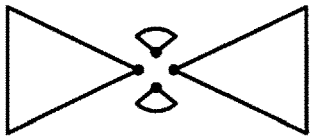
Figure 7K:
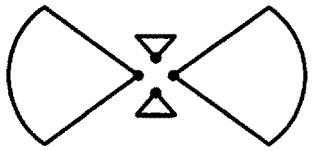
Figure 7L:
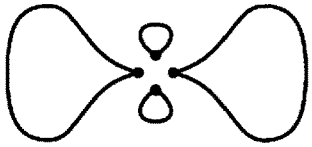

FIGS. 7A-7I shows various embodiments of dual polarization antennas 700 under the present disclosure. Each antenna 700 comprises two legs 710, 720, two parasitic/legs 730, 740, and four feeds 755. As shown, dual polarization antennas under the present disclosure can take a variety of shapes and sizes. The optional height-to-width ratio is 3:1 to 4:1 (height comprising a tip-to-tip measurement of the legs, width measuring a tip-to-tip measurement of the parasitics). But operational geometries can run up to 5:1, even to 15:1. Ratios of 1:1 can also be functional, such as in FIG. 7H. As shown in FIGS. 7J-7L, the legs of antennas under the present disclosure can also comprise planar inverted cone antennas. The variously shaped legs and parasitics of FIGS. 7A-7L can be combined in any variety of combinations, such that various shapes of different components can be used.

Figure 8:
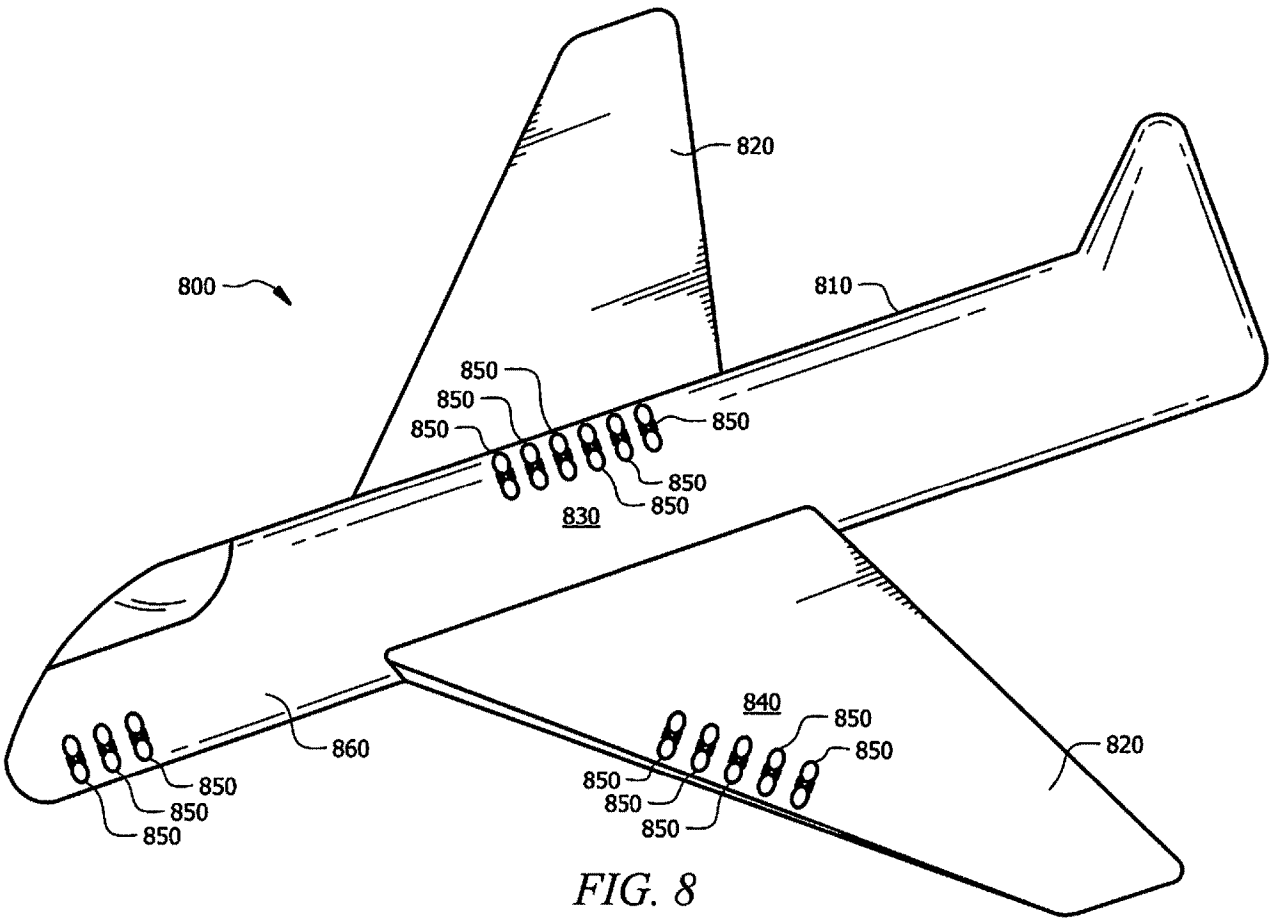
FIG. 8 shows a possible embodiment under the present disclosure.

FIG. 8 shows an antenna array comprising one embodiment of dual polarization antennas under the present disclosure. FIG. 8 displays an aircraft 800. However, other antenna arrays can comprise satellites, antenna towers, communication centers, or other systems, vehicles or locations that use antennas. Aircraft 800 comprises a fuselage 810 and wings 820. Wing 820 contains an antenna array 840 comprising a plurality of antennas 850. Antennas 850 can comprise any embodiment under the present disclosure, such as those shown in FIGS. 2, 5B, and 7A-7I. Aircraft 800 also comprises antenna array 830 on the top of fuselage 810, and array 860 in the front/cockpit area of fuselage 810. Antenna arrays are preferred on leading edges of the aircraft. However, antennas and arrays can be located on any surface of aircraft 800, and can cover a small portion, a medium portion, a large portion, substantially all, or all of the surface area of an aircraft 800.

FIG. 9 displays a possible method embodiment for constructing an antenna under the present disclosure. Under method 900, at step 910 a plurality of antenna legs is provided. At 920, a plurality of parasitic elements is placed between the antenna legs. In a preferred embodiment there are two legs and two parasitic elements, the legs extend along one line with a space between them. The parasitics are placed on either side, close to the space between the legs. At step 930, feeds are provided to the plurality of antenna legs. At step 940, feeds are provided to the plurality of parasitic elements.

FIG. 10 displays a possible method embodiment for constructing an antenna array under the present disclosure. Under method 1000, at step 1010 a plurality of antenna legs is provided. At 1020, a plurality of parasitic elements is placed between the antenna legs. At step 1030, feeds are provided to the plurality of antenna legs. At step 1040, feeds are provided to the plurality of parasitic elements. At 1050, the preceding steps are repeated across a given surface area to create the array.

Radar range can be defined by the equation given in FIG. 11. Low frequency waves allow for greater radar range. $P_T$ is transmit power. $G_T$ is transmission gain. $G_R$ is antenna gain. $\lambda$ is wavelength. $\sigma$ is radar cross section. $L_{atmos}$ is attenuation of the atmosphere. $P_R$ is the minimum detectable signal. Duty is the power load. It can be seen that lower frequency antennas can achieve desirable characteristics. As frequency goes down the wavelength goes up, leading to greater range. Atmospheric attenuation also rises with a lower frequency. For instance, high frequency signals can be difficult to transmit during rain (e.g. frequencies greater than 8 GHz). This problem is not as pronounced for low frequency signals. Low frequency antennas can also achieve lower Duty. Lower frequency antennas, due to the longer wavelength, generally require greater size. However the present teachings help minimize the antenna size needed to receive and send lower frequency signals.

Figure 12A:
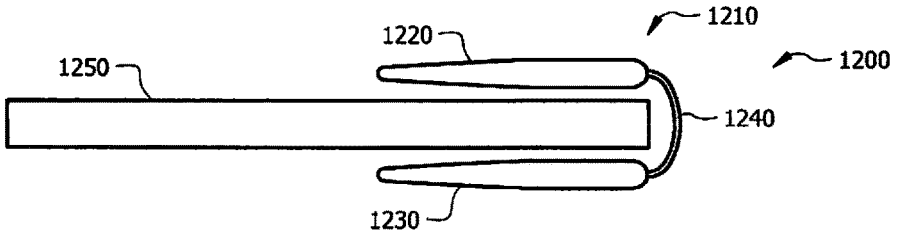
FIGS. 12A-12B show possible antenna embodiments under the present disclosure.
Figure 12B:
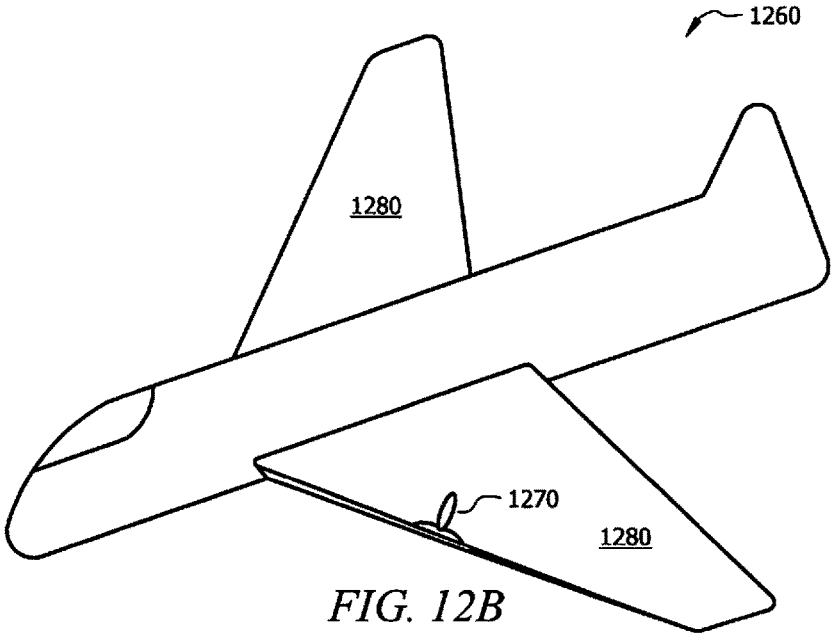

Further embodiments under the present disclosure can be seen in FIGS. 12A and 12B. These embodiments show how an antenna can be implemented on two sides of an underlying surface, or bent to conform to a thin substrate. FIG. 12A shows a dielectric substrate 1250. Legs 1220, 1230 of antenna 1210 are disposed on both sides of the dielectric 1250, one leg on each side. Feeds 1240 can connect to the dielectric 1250 or connect to another element not shown. Parasitic elements, as shown in other embodiments, such as FIGS. 7A-7L, are not shown but can be folded along their length to conform to an edge of dielectric 1250. Dielectric substrate 1250 can be any type of sheet, substrate, or thin surface. Such an embodiment can similarly be implemented along the edge of a wing, such as wing 1280 on aircraft 1260. Antenna 1270 can be any antenna under the present disclosure. A wing 1280 can comprise a plurality of antennas 1270 on an edge. The antenna embodiments of 12A and 12B can be attached to the substrate by a variety of different etching, mechanical attachment, bonding, sauntering, or similar processes.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna comprising:

a plurality of structural elements comprising connections to a first plurality of antenna feeds; and a plurality of orthogonal structural elements comprising connections to a second plurality of antenna feeds;

wherein the plurality of structural elements comprises two radiating structural elements considered to be active elements when radiating in a given direction; and the plurality of orthogonal structural elements comprises two capacitive coupled structural elements considered to be passive elements when not radiating in that given direction;

wherein the plurality of structural elements are configured to be one of vertically or horizontally polarized and the plurality of orthogonal structural elements are configured to be the other of vertically or horizontally polarized;

wherein the vertical or horizontal polarization of the plurality of structural elements and the vertical or horizontal polarization of the Plurality of orthogonal structural elements are happening simultaneously and separately;

the antenna has an impedance bandwidth greater than 5:1 as a result of the capacitive coupled structural elements effectively tuning the antenna over a broad a ≥5:1 bandwidth frequency range and matching the first plurality of antenna feeds and the second plurality of antenna feeds impedances to 50Ω over that broad ≥5:1 bandwidth frequency range.

2. The antenna of claim 1 wherein the antenna has a height to width ratio of 3:1 to 10:1.

3. The antenna of claim 1 wherein the first plurality of antenna feeds and the second plurality of antenna feeds impedances matched to 50Ω is approximately 0.3λ to 2λ of operation, for a structural element length of approximately 0.3λ.

4. A method of constructing a dual polarized antenna comprising:

providing a plurality of radiating structural elements, providing a plurality of capacitive coupled passive structural elements placed orthogonally to the plurality of radiating structural elements, providing a first plurality of feeds to the plurality radiating structural elements; and providing a second plurality of feeds to the plurality of orthogonal capacitive coupled passive structural elements;

the dual polarized antenna has an impedance bandwidth greater than 5:1 as a result of the capacitive coupled passive structural elements effectively tuning the antenna over a broad ≥5:1 bandwidth frequency range and matching the first plurality of antenna feeds and the second plurality of antenna feeds impedances to 50Ω over that broad ≥5:1 bandwidth frequency range.

5. The method of claim 4 wherein the first plurality of antenna feeds and the second plurality of antenna feeds impedances matched to 50Ω is approximately 0.3λ to 2λ of operation, for a structural element length of approximately 0.3λ.

6. The method of claim 4 wherein the first plurality of radiating structural elements are configured to be one of vertically or horizontally polarized and the second plurality of capacitive coupled passive structural elements are configured to be the other of vertically or horizontally polarized.

* * * * *